US006340218B1

(12) United States Patent
Gaylor

(10) Patent No.: US 6,340,218 B1
(45) **Date of Patent: *Jan. 22, 2002**

(54) SINGLE-PASS WIPING SYSTEM FOR INKJET PRINTHEADS

(75) Inventor: Dean A. Gaylor, Ridgefield, WA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/428,859

(22) Filed: Oct. 28, 1999

(51) Int. Cl.[7] ..... B41J 2/165
(52) U.S. Cl. ..... 347/33
(58) Field of Search ..... 347/33; 15/250.36, 15/701

(56) References Cited

U.S. PATENT DOCUMENTS

| | | | | |
|---|---|---|---|---|
| 5,151,715 | A | 9/1992 | Ward et al. | 347/33 |
| 5,300,958 | A | 4/1994 | Burke et al. | 347/33 |
| 5,489,927 | A | 2/1996 | Harmon | 347/33 |
| 5,500,660 | A | 3/1996 | Childers et al. | 347/33 |
| 5,583,548 | A | 12/1996 | Kearns | 347/33 |
| 5,602,573 | A | 2/1997 | Waschhauser et al. | 347/33 |
| 5,614,930 | A | 3/1997 | Osborne et al. | 347/33 |
| 5,745,133 | A | 4/1998 | Hendricks et al. | 347/33 |
| 6,189,999 | B1 * | 2/2001 | Pham et al. | 347/33 |

FOREIGN PATENT DOCUMENTS

| | | |
|---|---|---|
| EP | 0 446 885 | 9/1991 |
| JP | 362113553 | 5/1987 |
| JP | 08020112 | 1/1996 |

* cited by examiner

*Primary Examiner*—N. Le
*Assistant Examiner*—Shih-wen Hsieh
(74) *Attorney, Agent, or Firm*—Flory L. Martin

(57) ABSTRACT

A single-pass wiping system is provided for cleaning ink residue from an inkjet printhead in an inkjet printing mechanism. The wiper system includes a platform moveable through a wiping stroke, along with a first wiper blade and a second wiper blade each supported by the platform. A third intermediate wiper blade is supported by the platform between the first wiper blade and the second wiper blade to wipe ink residue from the printhead during a unidirectional wiping stroke through contact first with the first wiper blade, followed by contact with the third wiper blade, followed by contact with the second wiper blade. An inkjet printing mechanism is provided with a single-pass wiping system as described above, along with a method is provided for cleaning ink residue from an inkjet printhead in an inkjet printing mechanism.

19 Claims, 3 Drawing Sheets

SINGLE-PASS WIPING SYSTEM FOR INKJET PRINTHEADS

FIELD OF THE INVENTION

The present invention relates generally to inkjet printing mechanisms, and more particularly to a single-pass wiper system that removes ink residue from an inkjet printhead in a more time efficient manner than earlier systems, allowing the printhead to more quickly return to printing which increases the throughput rating of the unit (measured in pages per minute).

BACKGROUND OF THE INVENTION

Inkjet printing mechanisms use cartridges, often called "pens," which eject drops of liquid colorant, referred to generally herein as "ink," onto a page. Each pen has a printhead formed with very small nozzles through which the ink drops are fired. To print an image, the printhead is propelled back and forth across the page, ejecting drops of ink in a desired pattern as it moves. The particular ink ejection mechanism within the printhead may take on a variety of different forms known to those skilled in the art, such as those using piezo-electric or thermal printhead technology. For instance, two earlier thermal ink ejection mechanisms are shown in U.S. Pat. Nos. 5,278,584 and 4,683,481. In a thermal system, barrier layer containing ink channels and vaporization chambers is located between a nozzle orifice plate and a substrate layer. This substrate layer typically contains linear arrays of heater elements, such as resistors, which are energized to heat ink within the vaporization chambers. Upon heating, an ink droplet is ejected from a nozzle associated with the energized resistor. By selectively energizing the resistors as the printhead moves across the page, the ink is expelled in a pattern on the print media to form a desired image (e.g., picture, chart or text).

To clean and protect the printhead, typically a "service station" mechanism is supported by the printer chassis so the printhead can be moved over the station for maintenance. For storage, or during non-printing periods, the service stations usually include a capping system which substantially seals the printhead nozzles from contaminants and drying. Some caps are also designed to facilitate priming, such as by being connected to a pumping unit that draws a vacuum on the printhead. During operation, clogs in the printhead are periodically cleared by firing a number of drops of ink through each of the nozzles in a process known as "spitting," with the waste ink being collected in a "spittoon" reservoir portion of the service station. After spitting, uncapping, or occasionally during printing, most service stations have an elastomeric wiper that wipes the printhead surface to remove ink residue, as well as any paper dust or other debris that has collected on the printhead. The wiping action is usually achieved through relative motion of the printhead and wiper, for instance by moving the printhead across the wiper, by moving the wiper across the printhead, or by moving both the printhead and the wiper.

To improve the clarity and contrast of the printed image, recent research has focused on improving the ink itself. To provide quicker, more waterfast printing with darker blacks and more vivid colors, pigment-based inks have been developed. These pigment-based inks have a higher solid content than the earlier dye-based inks, which results in a higher optical density for the new inks. Both types of ink dry quickly, which allows inkjet printing mechanisms to form high quality images on readily available and economical plain paper, as well as on recently developed specialty coated papers, transparencies, fabric and other media. Unfortunately, the combination of small nozzles and quick drying ink leaves the printheads susceptible to clogging, not only from dried ink and minute dust particles or paper fibers, but also from the solids within the new inks themselves. Partially or completely blocked nozzles can lead to either missing or misdirected drops on the print media, either of which degrades the print quality. Thus, keeping the nozzle face plate clean becomes even more important when using pigment based inks, because they tend to accumulate more debris than the earlier dye based inks.

As the inkjet industry investigates new printhead designs, the tendency is toward using permanent or semi-permanent printheads in what is known in the industry as an "off-axis" printer. In an off-axis system, the printheads carry only a small ink supply across the printzone, with this supply being replenished through tubing that delivers ink from an "off-axis" stationary reservoir placed at a remote stationary location within the printer. There are a variety of advantages associated with these off-axis printing systems, but the permanent or semi-permanent nature of the printheads requires special considerations for servicing, particularly when wiping ink residue from the printheads, which must be done without any appreciable wear that could decrease printhead life. To accomplish this objective, an ink solvent has been used in an off-axis printer, specifically the DeskJet® 2000C Professional Series color inkjet printer, sold by the present assignee Hewlett-Packard Company. In this ink solvent system, a polyethylene glycol ("PEG") compound is stored in a porous medium such as a plastic or foam block that is in intimate contact with a reservoir, with this porous block having an applicator portion exposed so the elastomeric wiper can contact the applicator. This elastomeric wiper moves across the applicator to collect PEG, which is then wiped across the printhead to dissolve accumulated ink residue and to deposit a non-stick coating of PEG on the printhead face to retard farther collection of ink residue. The PEG fluid also acts as a lubricant, so the rubbing action of the wiper does not unnecessarily wear the printhead. Other wiper systems without a solvent have also been sold by the Hewlett-Packard Company in the DeskJet® 850C, 855C, 870C and 890C models of color inkjet printers. These scraper systems used a rotary tumbler to wipe the printheads. Another solventless wiper scraper system has been sold by the present assignee, the Hewlett-Packard Company, in the DeskJet® 720C, 722C, 710C, 712C, 810C, 812C, 830C, 832C, 880C, 882C, 895C and 970C models of inkjet printers, which used a translating pallet to wipe the wipers across the printheads.

All of the Hewlett-Packard Company's DeskJet® printer models mentioned in the paragraph above used wiper assemblies having the cross sectional configuration shown in FIGS. 4–6 of the drawings. FIG. 4 is a side view of a wiper assembly W at rest. FIGS. 5 and 6 show side views of the wiper assembly W making a two-pass wiping stroke, first to the right in FIG. 5, then to the left in FIG. 6, removing ink residue R from an external surface of an orifice plate of printhead P. The wiper assembly W has a first elastomeric wiper blade W1 and a second wiper blade W2 which are mounted to a sled S which moves the blades past the stationary printhead P to wiper the ink residue, Q and other debris from the orifice plate. This earlier dual-blade wiper system is described at length in U.S. Pat. No. 5,614,930, currently assigned to the Hewlett-Packard Company, and was first used in the Hewlett-Packard Company's DeskJet® 850C color inkjet printer. The DeskJet® model 850C printer employed a revolutionary rotary, orthogonal wiping scheme where the wipers ran along the length of the linear arrays, wicking ink I from one nozzle to the next. This wicked ink I acted as a solvent to break down ink residue accumulated on the nozzle plate. To facilitate this wicking action and subsequent printhead cleaning accomplish this wiping action, the wiper blades W1 and W2 have special contours at their tips. The blades W1 and W2 are mirror-images of each other, having outboard rounded edges R1 and R2, respectively, and inboard angular wiping edges A1 and A2, respectively. The rounded edges encounter the nozzles first and form a capillary channel between the blade and the orifice plate to wick liquid ink I from the nozzles as the wipers moved orthogonally along the length of the nozzle arrays, as shown for edge R2 in FIG. 5 and edge R1 in FIG. 6. The wicked ink I is pulled by the rounded edges R1, R2 of the leading wiper blade to the next nozzle in the array, where the ink I acts as a solvent to dissolve dried ink residue 9 accumulated on the printhead face plate. The angular edge of the trailing wiper blade then scraps the dissolved residue Q' from the orifice plate, as shown for edge A1 in FIG. 5 and edge A2 in FIG. 6. The black ink wiper had notches cut in the tip which served as escape passageways for balled-up ink residue to be moved away from the nozzle arrays during the wiping stroke.

Unfortunately, the dual bladed wiping assembly W of FIGS. 4–6 required a back-and-forth slewing motion, first in the direction of arrow D1 (FIG. 5), then in the opposite direction of arrow D2, to wipe the ink residue and foreign debris. Q, Q' from the printhead P. The back-and-forth wiping strokes were required to mask any defects in the wiper tip. Since the wiper tips are non-uniform, the redundancy in using two different surfaces for wiping masks the tip imperfections because there is an extremely low likelihood that both blades will have the same imperfections at the same lateral location across their tips. Thus, on each pass, a different wiping edge is used to clean the printhead, specifically, edges R2 and A1 when traveling in the D1 direction in FIG. 5, and edges R1 and A2 when traveling in the D2 direction in FIG. 6. The problem with this bi-directional wiping scheme is that it severely reduced the printer's throughput, a printer rating measured in pages per minute, because of the time required to slew the wiper back-and-forth to complete a wiping routine. Especially as the length of printhead nozzle arrays increases, nearing one inch (2.54 centimeters), wiping cycles of over three seconds are anticipated when using this earlier bi-directional wiping scheme. Given the fact that it is desirable to wipe the printhead not only before a printjob, but also periodically during a printjob, this bi-directional operation began to seriously impact desired throughput goals.

Thus, a need exists for an inkjet printhead cleaning system which wipes ink residue and ink solvent from the printhead more quickly without impacting the throughput rating of a unit.

SUMMARY OF THE INVENTION

According to one aspect of the present invention, a single-pass wiping system is provided for cleaning ink residue from an inkjet printhead in an inkjet printing mechanism. The wiper system includes a platform moveable through a wiping stroke, along with a first wiper blade and a second wiper blade each supported by the platform. A third wiper blade is supported by the platform between the first wiper blade and the second wiper blade to wipe ink residue from the printhead during a unidirectional wiping stroke through contact first with the first wiper blade, followed by contact with the third wiper blade, followed by contact with the second wiper blade.

According to another aspect of the present invention, an inkjet printing mechanism is provided with a single-pass wiping system as described above.

According to yet another aspect of the present invention, a method is provided for cleaning ink residue from an inkjet printhead in an inkjet printing mechanism, including the step of providing a first wiper blade, a second wiper blade, and a third wiper blade, each supported by the platform, with the third wiper blade located between the first wiper blade and the second wiper blade. In a wiping step, ink residue is wiped from the printhead in a unidirectional wiping stroke by first wiping the printhead with the first wiper blade, followed by wiping the printhead with the third wiper blade, followed by wiping the printhead with the second wiper blade.

An overall goal of the present invention is to provide an inkjet printing mechanism which prints sharp vivid images over the life of the printhead and the printing mechanism, particularly when using fast drying pigment or dye-based inks, whether dispensed from an off-axis system or from a replaceable ink cartridge system.

Another important goal of the present invention is to provide a single-pass wiper system and method for wiping an inkjet printhead in an inkjet printing mechanism, without seriously impacting the throughput of a unit to provide consumers with a fast inkjet printing mechanism.

Still another goal of the present invention is to provide a single-pass wiper system for cleaning printhead wipers in an inkjet printing mechanism which is quieter than earlier systems, and which thus provides consumers with a reliable, quiet inkjet printing unit.

DETAILED DESCRIPTION OF A PREFERRED EMBODIMENT

Figure 1:
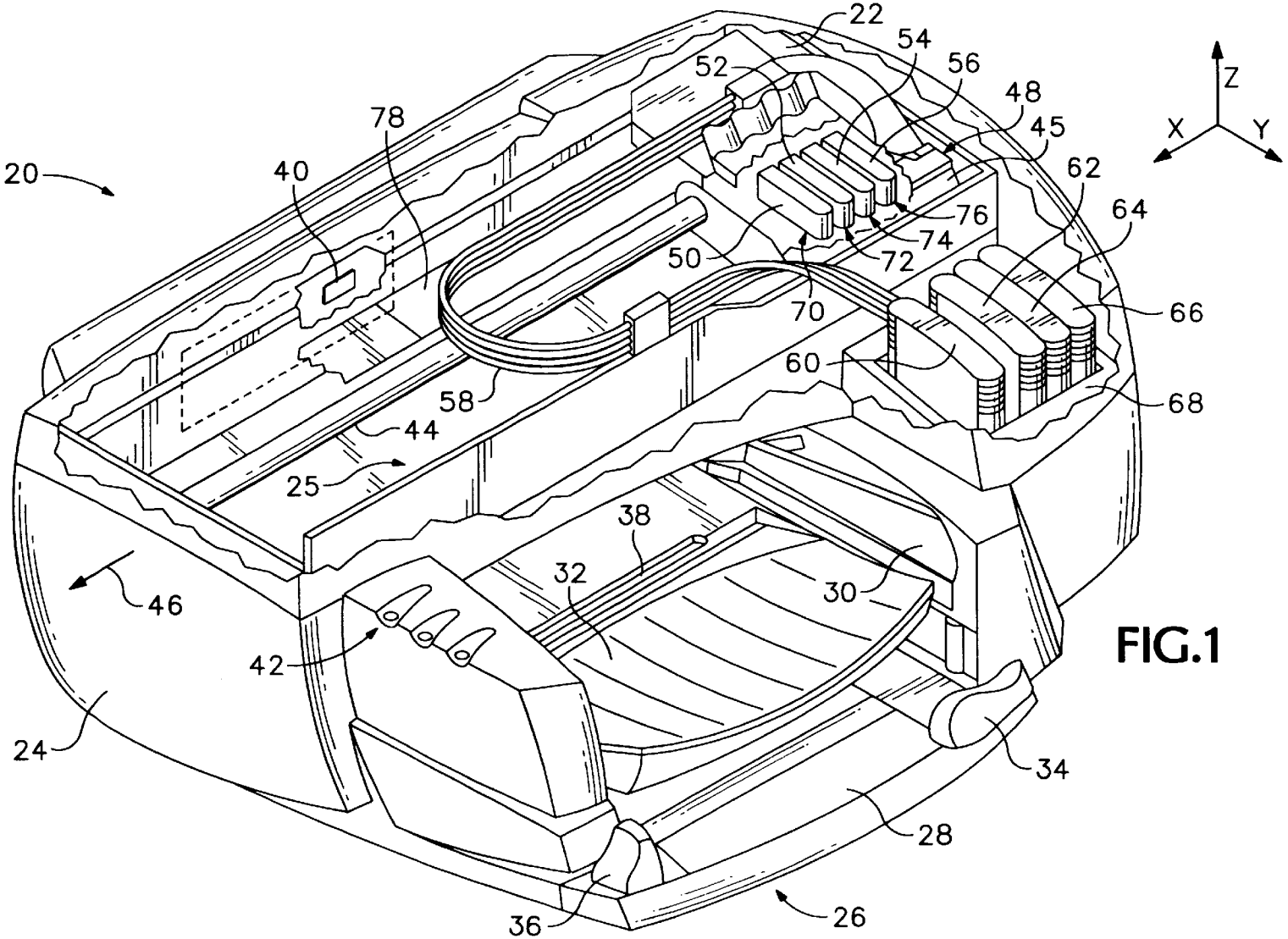
FIG. 1 is a perspective view of one form of an inkjet printing mechanism, here, an inkjet printer, including a printhead service station having one form of a single-pass wiper system-of the present invention for cleaning an inkjet printhead wiper.

FIG. 1 illustrates an embodiment of an inkjet printing mechanism, here shown as an "off-axis" inkjet printer 20, constructed in accordance with the present invention, which may be used for printing for business reports, correspondence, desktop publishing, and the like, in an industrial, office, home or other environment. A variety of inkjet printing mechanisms are commercially available. For instance, some of the printing mechanisms that may embody the present invention include plotters, portable printing units, copiers, cameras, video printers, and facsimile machines, to name a few, as well as various combination devices, such as a combination facsimile/printer. For convenience the concepts of the present invention are illustrated in the environment of an inkjet printer 20.

While it is apparent that the printer components may vary from model to model, the typical inkjet printer 20 includes a frame or chassis 22 surrounded by a housing, casing or enclosure 24, typically of a plastic material. Sheets of print media are fed through a printzone 25 by a media handling system 26. The print media may be any type of suitable sheet material, such as paper, card-stock, transparencies, photographic paper, fabric, mylar, and the like, but for convenience, the illustrated embodiment is described using paper as the print medium. The media handling system 26 has a feed tray 28 for storing sheets of paper before printing. A series of conventional paper drive rollers driven by a stepper motor and drive gear assembly (not shown), may be used to move the print media from the input supply tray 28, through the printzone 25, and after printing, onto a pair of extended output drying wing members 30, shown in a retracted or rest position in FIG. 1. The wings 30 momentarily hold a newly printed sheet above any previously printed sheets still drying in an output tray portion 32, then the wings 30 retract to the sides to drop the newly printed sheet into the output tray 32. The media handling system 26 may include a series of adjustment mechanisms for accommodating different sizes of print media, including letter, legal, A-4, envelopes, etc., such as a sliding length adjustment lever 34, a sliding width adjustment lever 36, and an envelope feed port 38.

The printer 20 also has a printer controller, illustrated schematically as a microprocessor 40, that receives instructions from a host device, typically a computer, such as a personal computer (not shown). The printer controller 40 may also operate in response to user inputs provided through a key pad 42 located on the exterior of the casing 24. A monitor coupled to the computer host may be used to display visual information to an operator, such as the printer status or a particular program being run on the host computer. Personal computers, their input devices, such as a keyboard and/or a mouse device, and monitors are all well known to those skilled in the art.

A carriage guide rod 44 is supported by the chassis 22 to slideably support an off-axis inkjet pen carriage system 45 for travel back and forth across the printzone 25 along a scanning axis 46. The carriage 45 is also propelled along guide rod 44 into a servicing region, as indicated generally by arrow 48, located within the interior of the housing 24. A conventional carriage drive gear and DC (direct current) motor assembly may be coupled to drive an endless belt (not shown), which may be secured in a conventional manner to the carriage 45, with the DC motor operating in response to control signals received from the controller 40 to incrementally advance the carriage 45 along guide rod 44 in response to rotation of the DC motor. To provide carriage positional feedback information to printer controller 40, a conventional encoder strip may extend along the length of the printzone 25 and over the service station area 48, with a conventional optical encoder reader being mounted on the back surface of printhead carriage 45 to read positional information provided by the encoder strip. The manner of providing positional feedback information via an encoder strip reader may be accomplished in a variety of different ways known to those skilled in the art.

Figure 2:
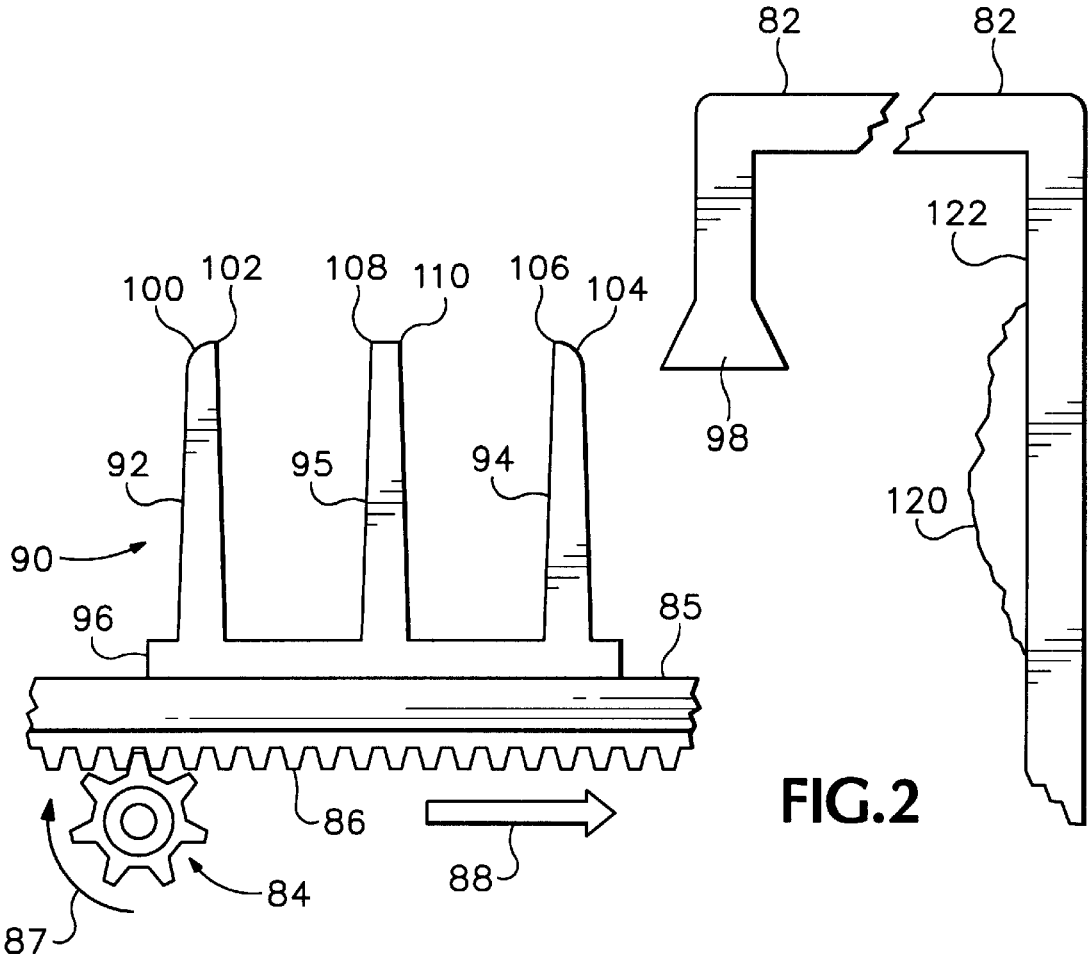
FIG. 2 is an enlarged side elevational view of the single-pass wiper system of FIG. 1, shown at rest.

In the printzone 25, a sheet of print media receives ink from an inkjet cartridge, such as a black ink cartridge 50 and three monochrome color ink cartridges 52, 54 and 56, shown schematically in FIG. 2. The cartridges 50–56 are also often called "pens" by those in the art. The black ink pen 50 is illustrated herein as containing a pigment-based ink. While the illustrated color pens 52–56 may contain pigment-based inks, for the purposes of illustration, color pens 52–56 are described as each containing a dye-based ink of the colors cyan, magenta and yellow, respectively. It is apparent that other types of inks may also be used in pens 50–56, such as paraffin-based inks, as well as hybrid or composite inks having both dye and pigment characteristics.

The illustrated pens 50–56 each include small reservoirs for storing a supply of ink in what is known as an "off-axis" ink delivery system, which is in contrast to a replaceable cartridge system where each pen has a reservoir that carries the entire ink supply as the printhead reciprocates over the printzone 25 along the scan axis 46. Hence, the replaceable cartridge system may be considered as an "on-axis" system, whereas systems which store the main ink supply at a stationary location remote from the printzone scanning axis are called "off-axis" systems. Other hybrid systems known as "snapper systems" have replaceable ink reservoirs which snap onto permanent or semi-permanent printheads. All of these different types of printhead systems may be cleaned using the servicing system described below.

In the illustrated off-axis printer 20, ink of each color for each printhead is delivered via a conduit or tubing system 58 from a group of main stationary reservoirs 60, 62, 64 and 66 to the on-board reservoirs of pens 50, 52, 54 and 56, respectively. The stationary or main reservoirs 60-66 are replaceable ink supplies stored in a receptacle 68 supported by the printer chassis 22. Each of pens 50, 52, 54 and 56 have printheads 70, 72, 74 and 76, respectively, which selectively eject ink to from an image on a sheet of media in the printzone 25. The concepts disclosed herein for cleaning the printheads 70–76 apply equally to the totally replaceable inkjet cartridges and snapper systems, as well as to the illustrated off-axis semi-permanent or permanent printheads, although the greatest benefits of the illustrated system may be realized in snapper and off-axis systems where extended printhead life is particularly desirable.

The printheads 70, 72, 74 and 76 each have an orifice plate with a plurality of nozzles formed therethrough in a manner well known to those skilled in the art. The nozzles of each printhead 70–76 are typically formed in at least one, but typically two linear arrays along the orifice plate. Thus, the term "linear" as used herein may be interpreted as "nearly linear" or substantially linear, and may include nozzle arrangements slightly offset from one another, for example, in a zigzag arrangement. Each linear array is typically aligned in a longitudinal direction perpendicular to the scanning axis 46, with the length of each array determining the maximum image swath for a single pass of the printhead. The illustrated printheads 70–76 are thermal inkjet printheads, although other types of printheads may be used, such as piezoelectric printheads. The thermal printheads 70–76 typically include a plurality of resistors which are associated with the nozzles. Upon energizing a selected resistor, a bubble of gas is formed which ejects a droplet of ink from the nozzle and onto a sheet of paper in the printzone 25 under the nozzle. The printhead resistors are selectively energized in response to firing command control signals delivered by a multi-conductor strip 78 from the controller 40 to the printhead carriage 45.

Single-Pass Wiping Service Station System

Figure 3:
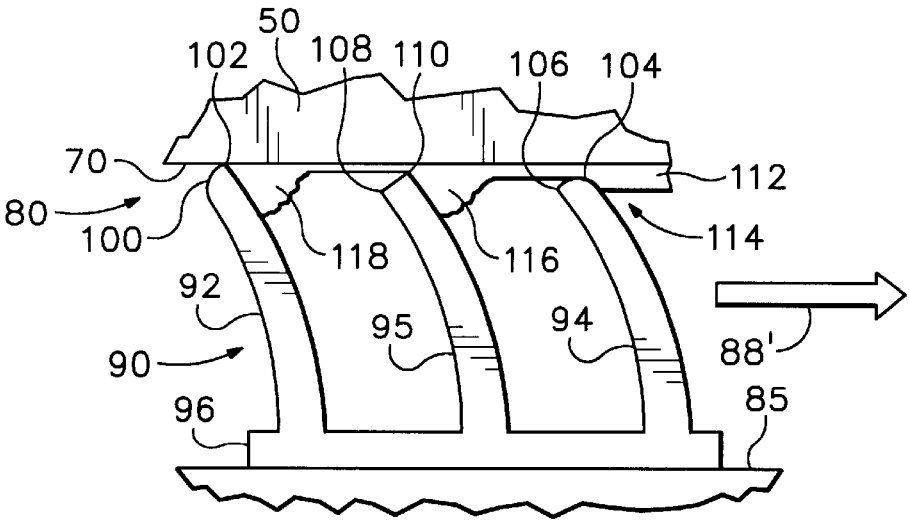
FIG. 3 is an enlarged side elevational view of the single-pass wiper system of FIGS. 1 and 2, shown cleaning the printhead in a single direction of movement.
Figure 4:
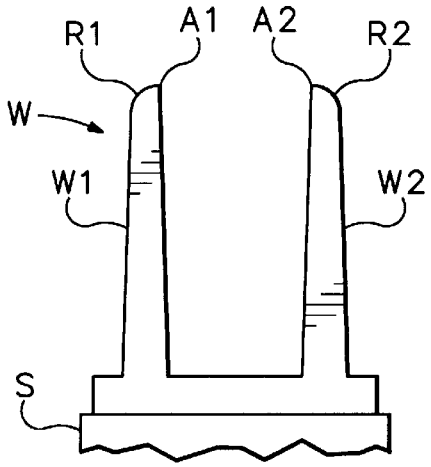
FIG.4 (PRIOR ART)
FIG. 4 is a side elevational view of a prior art dual-bladed, bi-directional wiper system described in the Background section above, shown at rest.
Figure 5:
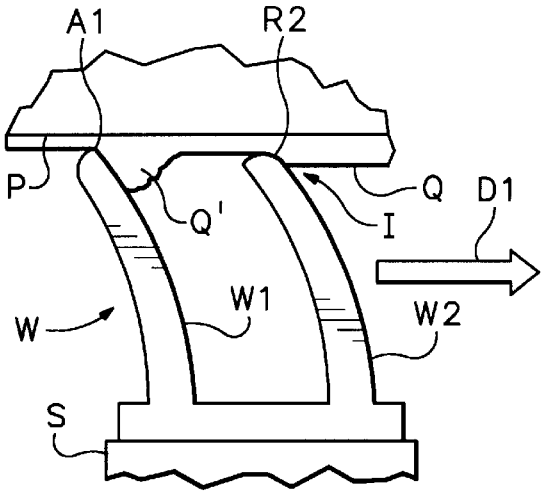
FIG.5 (PRIOR ART)
FIG. 5 is a side elevational view of the prior art wiper system of FIG. 4, shown cleaning an inkjet printhead in a first direction of movement.
Figure 6:
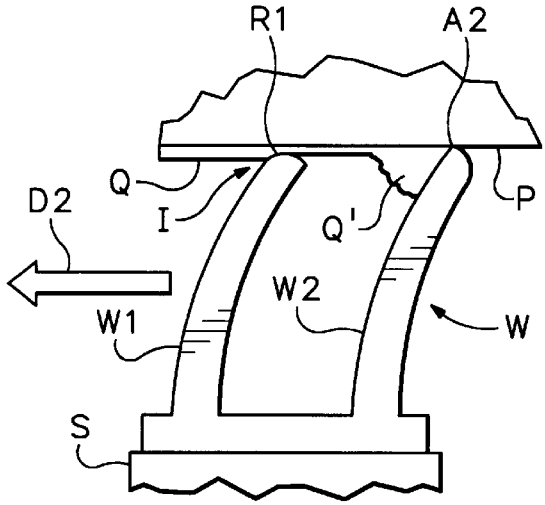
FIG.6 (PRIOR ART)
FIG. 6 is a elevational view of the prior art wiper system of FIGS. 4 and 5, shown cleaning the inkjet printhead in a second direction of movement, opposite the direction shown in FIG. 5.

FIGS. 2 and 3 illustrate one form of a single pass wiper service station system 80, constructed in accordance with the present invention, including a stationary frame 82 which is supported by the printer chassis 22 in the servicing region 48 within the printer casing 24. To service printheads 70–76 of the pens 50–56, the service station 80 includes a stepper motor and pinion gear assembly 84 coupled to drive a moveable platform or pallet member 85 through engagement with a rack gear 86 located along the underside of the pallet 85. Here, as the gear of assembly 84 rotates in the direction of curved arrow 87, the servicing platform 85 is shown as a translationally moving member, moving in a rearward direction as indicated by arrow 88 in FIG. 2, although a rotary platform, or a combination platform having both rotary and translational motion, may also be used.

Several wiper blade assemblies, such as wiper blade assembly 90, may be supported along the upper surface of the pallet 85. Indeed, preferably platform 85 supports one such wiper assembly for each printhead 70–76, but for the purposes of operational illustration, only the black wiper assembly 90 is shown for cleaning the black printhead 70. The wiper assembly 90 may be molded from a resilient, non-abrasive, elastomeric material, such as nitrile rubber, ethylene polypropylene diene monomer (EPDM), or other comparable materials known in the art. For the assembly 90, a suitable durometer, that is, the relative hardness of the elastomer, may be selected from the range of 35–80 on the Shore A scale, or more preferably within the range of 60–80, or even more preferably at a durometer of 70+/−5, which is a standard manufacturing tolerance.

The wiper assembly 90 is a tri-blade design, having a pair of outboard wiper blades 92 and 94, between which is sandwiched a medial or interior wiper blade 95. The blades 92, 94 and 95 may be separately mounted to the pallet 85, or more preferably, the blades are molded together as a single unit extending upwardly from a base portion 96. Another desirable component of the single pass wiper service station 80 is a wiper scraper bar 98, which extends downwardly from an upper portion of the service station frame 82 and into the path of the wiper blades 92–95 to scrape ink residue from the blades when passing under the scraper bar 98.

Preferably, the exterior wiper blades 92 and 94 are formed as described in U.S. Pat. No. 5,614,930, which is discussed in the Background section above. The first exterior blade 92 has a rounded outboard wiping edge 100, and an angular interior wiping edge 102, while the second exterior blade 94 has a rounded outboard wiping edge 104, and an angular interior wiping edge 106. The medial blade 95 has two opposing angular wiping edges 108 and 110. While the blades 92–95 may be all of the same width, one or more may be of a different width. For instance, the medial blade 95 may be wider than the printhead to remove ink and other debris, such as fibers, which may be clinging to the two cheek regions of the printhead located to each side of the nozzle orifice plate. Use of such a wider blade in conjunction with an orifice plate width blade was commercially available in the service station for the DeskJet® 2000C Professional Series color inkjet printer, sold by the present assignee, the Hewlett-Packard Company.

FIG. 3 shows the single-pass wiper assembly 90 in operation performing a method of cleaning the black printhead 70 in a single, unidirectional wiping stroke, shown here moving the blades 92–95 to the right as indicated by arrow 88'. Accumulated ink residue 112 is first encountered by the rounded wiping edge 104 of the leading blade 94. As described in U.S. Pat. No. 5,614,930, the leading rounded edge 104 wicks ink 114 from the nozzle it is wiping, then moves this wicked ink 114 to the next nozzles encountered in the array. This wicked ink 114 acts as both an ink residue solvent and an orifice plate lubricant. Dissolved ink residue 116, which passes under the rounded wiping edge 104 of the leading blade 94, then accumulates between blades 94 and 95, where it is encountered by the leading edge 110 of the medial blade 95. Any remaining ink residue 118 which escapes under the medial blade 95 is then wiped away by the angular wiping edge 102 of the trailing blade 92, leaving the printhead substantially clear of ink residue 112.

Following the wiping stroke of FIG. 3, the wiper blades 92–95 pass under the scraper bar 98 to the right in the direction of arrow 88 (FIG. 2) in a scraping stroke. The ink residue 112–118 accumulated on the leading surfaces and wiper tips of the blades 92–95 encounters the exterior edge of the scraper bar 98 and is flicked off the blades to land within the interior of the service station frame 82, such as shown for the scraped ink residue 120. After all of the wiper blades 92–95 have passed under the scraper bar 98, the wiper assembly 90 may be stored at rest within a wiper storage area 122 defined by the service station frame 82. Upon exiting the storage area 122, moving in the direction opposite to arrow 88, any ink residue remaining on the surfaces facing toward the left in the views of FIGS. 2 and 3 of blades 92–95 is removed by the interior edge of the scraper bar 98.

After exiting the wiper storage area 122, the symmetrical nature of the wiper assembly 90 advantageously allows a single-pass wiping stroke in the direction opposite to arrow 88', with blade 92 serving as the leading blade and blade 94 being the trailing blade. In this manner wiping edges 100, 108 and 106 of blades 92, 94 and 95 are then used to clean the printhead 70, in the same matter as described above with respect to FIG. 3. Ink residue collected on the blades 92–95 during this reverse wiping stroke is removed by passing the wiper assembly under the scraper bar 98 as described above, to ready the wiper assembly 90 for the next wiping stroke.

CONCLUSION

A variety of advantages may be realized using the single-pass wiper service station 80. One of the main advantages of the illustrated service station 80 is the ability to perform a unidirectional wiping stroke that cleans the printheads 70–76 with the same efficiency as the earlier dual-bladed wiper assemblies were able to accomplish with a time-consuming bi-directional wiping stroke. It is apparent however, that in some instances, it may be desirable to perform a bi-directional wiping stroke, indeed even a series of bi-directional wiping strokes, such as after a heavy spit routine used to recover clogged or partially clogged nozzles. One such mopping type of wiping routine is described in U.S. Pat. No. 5,614,930, which also describes the earlier dual-bladed wiping system mentioned above.

Moreover, while the description above implies that the wiper blades 92–95 have wiping edges 100–110 which are straight across their entire width, it is apparent to those skilled art that in some implementations it may be preferable to provide the blades, such as the black blades 92–95, with ink residue escape recesses as taught in U.S. Pat. No. 5,614,930. Furthermore, the wiper assembly 90 may also be used with an ink solvent application system, such as that which is commercially available in the DeskJet® 2000C Professional Series color inkjet printer as described in the Background section above.

It is apparent that other modifications may be made to the illustrated wiper assembly 90 while still employing the concepts described herein. For instance, while the wiper assembly 90 is shown with the medial blade 95 located centrally between the outboard blades 92 and 94, in some implementations it may be desirable to locate the medial blade 95 closer to one outboard blade than to the other. Shifting the medial blade 95 closer to one outboard blade may change the wiping characteristics of the strokes in each direction, such as by yielding a more robust wiping stroke in one direction and a gentler stroke in the opposite direction.

Another significant advantage of the single-pass wiper service station 80 is that the wiping operation has the potential to be quieter than the wiping operation performed by the earlier dual-bladed wiper assemblies. For instance, in a dual bladed system, the wipers first wipe in one direction, then they must stop, and then reverse direction for the second half of the bi-directional stroke. This stopping and reversing the direction of the pallet carrying the wiper assembly generates motor and gear noises which may be undesirable to some operators. The unidirectional single pass wiping stroke accomplished with the tri-bladed wiper assembly 90 advantageously eliminates the noise associated with stopping and reversing the direction of travel of the pallet during a bi-directional wiping stroke. An additional advantage of the single-pass wiping system 80 is that the wiping control algorithms processed by the controller 40 are simplified, leaving more computational time available for other printing subroutines.

Finally, another main advantage of the single-pass wiper service station 80 is the ability to significantly increase the overall throughput of the printer 20 by cutting down the time require to wipe the printheads by about 20% from that required for wiping with the earlier dual-bladed wiping system described in the Background section above. Use of the single-pass wiping system 80 increases the throughput rating, measured in pages per minute, of the printer 20, while efficiently cleaning the printheads 70–76 to maintain high print quality, providing consumers with a more robust, faster printing unit.

I claim:

1. A wiping system for cleaning ink residue from an inkjet printhead in a printing mechanism, comprising:

a platform moveable through opposing first and second single-pass wiping strokes which are separated in time by printing activity of the printhead;

a first wiper blade and a second wiper blade each supported by the platform; and a third wiper blade supported by the platform between the first wiper blade and the second wiper blade, wherein the first, second, and third wiper blades each contact and wipe ink residue from the printhead during each of the separate first and second single-pass wiping strokes.

2. A wiping system according to claim 1 wherein:

the first and second wiper blades each have an interior wiping edge facing the third wiper blade, and an exterior wiping edge facing away from the third blade;

the interior wiping edge of both the first and second wiper blades is angular; and the exterior wiping edge of both the first and second wiper blades is arcuate.

3. A wiping system according to claim 2 wherein:

the third wiper blade has a first wiping edge facing toward the first wiper blade, and a second wiping edge facing toward the second blade; and the first and second wiping edges of the third wiper blade are both angular.

4. A wiping system according to claim 2 wherein:

the interior wiping edge of both the first and second wiper blades is substantially rectangular; and the exterior wiping edge of both the first and second wiper blades is rounded.

5. A wiping system according to claim 4 wherein:

the third wiper blade has a first wiping edge facing toward the first wiper blade, and a second wiping edge facing toward the second blade; and the first and second wiping edges of the third wiper blade are both substantially rectangular.

6. A wiping system according to claim 1 wherein two of the first, second and third wiper blades are substantially the same width.

7. A wiping system according to claim 1 wherein the first, second and third wiper blades are all of substantially the same width.

8. A wiping system according to claim 1 wherein the third wiper blade is substantially centrally located between the first and second wiper blades.

9. A wiping system according to claim 1 further including an elastomeric base from which the first, second and third wiper blades project and are integrally formed therewith, with the base being supported by the platform.

10. A method of cleaning ink residue from an inkjet printhead in a printing mechanism, comprising:

providing a first wiper blade, a second wiper blade, and a third wiper blade, each supported by a platform movable through opposing first and second single-pass wiping strokes, wherein the third wiper blade is located between the first wiper blade and the second wiper blade;

wiping ink residue from the printhead with the first single-pass wiping stroke through contact with the three wiper blades;

accumulating new ink residue on the printhead; and wiping the new ink residue from the printhead with the second single-pass wiping stroke through contact with the three wiper blades.

11. A method of cleaning ink residue from an inkjet printhead in a printing mechanism according to claim 10 wherein:

wiping ink residue from the printhead with the first single-pass wiping stroke through contact with the three wiper blades further comprises wiping the printhead with an arcuate wiping edge of the first wiper blade; and wiping the new ink residue from the printhead with the second single-pass wiping stroke through contact with the three wiper blades further comprises wiping the printhead with an arcuate wiping edge of the second wiper blade.

12. A method of cleaning ink residue from an inkjet printhead in a printing mechanism according to claim 11 wherein:

wiping ink residue from the printhead with the first single-pass wiping stroke through contact with the three wiper blades further comprises wiping the printhead with an angular wiping edge of the second wiper blade; and wiping the new ink residue from the printhead with the second single-pass wiping stroke through contact with the three wiper blades further comprises wiping the printhead with an angular wiping edge of the first wiper blade.

13. A method of cleaning ink residue from an inkjet printhead in a printing mechanism according to claim 12 wherein:

wiping ink residue from the printhead with the first single-pass wiping stroke through contact with the three wiper blades further comprises wiping the printhead with an angular wiping edge of the third wiper blade; and wiping the new ink residue from the printhead with the second single-pass wiping stroke through contact with the three wiper blades further comprises wiping the printhead with an angular wiping edge of the third wiper blade.

14. An inkjet printing mechanism comprising:

an inkjet printhead;

a platform moveable through opposing first and second single-pass wiping strokes which are separated in time by printing activity of the printhead;

a first wiper blade and a second wiper blade each supported by the platform; and a third wiper blade supported by the platform between the first wiper blade and the second wiper blade, wherein the first, second, and third wiper blades each contact and wipe ink residue from the printhead during each of the separate first and second single-pass wiping strokes.

15. An inkjet printing mechanism according to claim 14 wherein:

the first and second wiper blades each have an interior wiping edge facing the third wiper blade, and an exterior wiping edge facing away from the third blade;

the interior wiping edge of both the first and second wiper blades is angular; and the exterior wiping edge of both the first and second wiper blades is arcuate.

16. An inkjet printing mechanism according to claim 14 wherein:

the third wiper blade has a first wiping edge facing toward the first wiper blade, and a second wiping edge facing toward the second blade; and the first and second wiping edges of the third wiper blade are both angular.

17. An inkjet printing mechanism according to claim 14 wherein two of the first, second and third wiper blades are substantially the same width.

18. An inkjet printing mechanism according to claim 14 wherein the third wiper blade is substantially centrally located between the first and second wiper blades.

19. An inkjet printing mechanism according to claim 14 further including an elastomeric base from which the first, second and third wiper blades project and are integrally formed therewith, with the base being supported by the platform.

* * * * *